US009388514B2

(12) United States Patent
Roh

(10) Patent No.: US 9,388,514 B2
(45) Date of Patent: Jul. 12, 2016

(54) METHOD OF PRODUCING ELECTRICALLY CONDUCTIVE METAL COMPOSITE YARN HAVING INCREASED YIELD STRENGTH, COMPOSITE YARN PRODUCED BY THE METHOD AND EMBROIDERED CIRCUIT PRODUCED USING THE COMPOSITE YARN

(71) Applicant: SANGMYUNG UNIVERSITY SEOUL INDUSTRY-ACADEMY COOPERATION FOUNDATION, Seoul (KR)

(72) Inventor: Jung Sim Roh, Seoul (KR)

(73) Assignee: SANGMYUNG UNIVERSITY SEOUL INDUSTRY-ACADEMY COOPERATION FOUNDATION (KR)

( * ) Notice: Subject to any disclaimer, the term of this patent is extended or adjusted under 35 U.S.C. 154(b) by 0 days.

(21) Appl. No.: 14/350,414

(22) PCT Filed: Jun. 4, 2013

(86) PCT No.: PCT/KR2013/004896

§ 371 (c)(1),
(2) Date: Apr. 8, 2014

(87) PCT Pub. No.: WO2014/175503

PCT Pub. Date: Oct. 30, 2014

(65) Prior Publication Data

US 2016/0145776 A1 May 26, 2016

(30) Foreign Application Priority Data

Apr. 23, 2013 (KR) ..... 10-2013-0044843

(51) Int. Cl.

| | |
|---|---|
| ***D02G 3/12*** | (2006.01) |
| ***D02G 3/36*** | (2006.01) |
| ***D02G 3/26*** | (2006.01) |

(52) U.S. Cl.

CPC .. *D02G 3/12* (2013.01); *D02G 3/26* (2013.01); *D02G 3/36* (2013.01)

(58) Field of Classification Search

CPC ..... D02G 3/12; D02G 3/26; D02G 3/28; D02G 3/36; D02G 3/441; D05C 7/06; H05K 1/038

See application file for complete search history.

(56) References Cited

U.S. PATENT DOCUMENTS 3,291,897 A * 12/1966 Bramley ..... H01B 5/008 174/126.1
3,490,224 A * 1/1970 Bourgeas ..... D02G 3/12 57/210

(Continued)

FOREIGN PATENT DOCUMENTS

| | | |
|---|---|---|
| KR | 100688899 | 2/2007 |
| KR | 100895092 | 4/2009 |
| KR | 101015563 | 2/2011 |

*Primary Examiner* — Shaun R Hurley
(74) *Attorney, Agent, or Firm* — Cantor Colburn LLP

(57) ABSTRACT

Provided are a method of producing an electrically conductive metal composite yarn applicable to a smart textile in which electrical, electronic and IT technologies are combined with an electronic circuit technology using fiber, an electrically conductive metal composite yarn produced by the method, and an embroidered circuit produced using the electrically conductive metal composite yarn, the method including: a first process of producing a covered yarn by wrapping a conductive yarn around a surface of a yarn; a second process of producing a twisted covered-yarn by additionally twisting the covered yarn produced through the first process; and a third process of producing a reinforced plied-yarn by wrapping a yarn around a surface of multiple strands of the twisted covered-yarn in a covered state to increase yield strength of the conductive yarn.

6 Claims, 8 Drawing Sheets

(56) References Cited

U.S. PATENT DOCUMENTS 3,582,444 A * 6/1971 Ngo ..... D02G 3/12 139/391
3,590,570 A * 7/1971 Okuhashi ..... D02G 3/441 57/238
4,776,160 A * 10/1988 Rees ..... D01H 1/10 57/210
4,793,130 A * 12/1988 Togashi ..... D02G 3/12 57/210
8,505,474 B2 * 8/2013 Kang ..... A41D 27/00 112/475.18
2003/0209003 A1 * 11/2003 Verstraeten ..... D02G 3/441 57/212
2004/0057176 A1 * 3/2004 Dhawan ..... D02G 3/38 361/62
2008/0282665 A1 * 11/2008 Speleers ..... D02G 3/12 57/212
2009/0056300 A1 * 3/2009 Chung ..... D02G 3/12 57/256
2010/0325770 A1 * 12/2010 Chung ..... D02G 3/36 2/69
2011/0072776 A1 * 3/2011 De Greve ..... B60N 2/5685 57/211
2011/0130060 A1 * 6/2011 Chung ..... D02G 3/12 442/189
2013/0008209 A1 * 1/2013 De Ridder ..... C03B 23/0252 65/374.11
2014/0090739 A1 * 4/2014 Harris ..... D02G 3/38 139/35
2014/0262478 A1 * 9/2014 Harris ..... H05K 9/009 174/393

* cited by examiner

EXISTING METHOD (N1)

NEW DEVELOPED METHOD (N2)

EXISTING METHOD (C1)

NEW DEVELOPED METHOD (C2)

EXISTING METHOD (C3)

NEW DEVELOPED METHOD (C4)

FIG. 6

| Evaluation Items | Electrically Conductive Metal Composite Yarn | | | | | |
|---|---|---|---|---|---|---|
| | Non-Coated Yarn (N) | | Insulation Coating Yarn (C) | | | |
| | Existing Method N1 | Newly Developed Method N2 | Existing Method C1 | Newly Developed Method C2 | Existing Method C3 | Newly Developed Method C4 |
| Used Material | Three strands of Ag-coated copper (diameter of metal filament: 40 μm), three strands of 75 denier polyester | Three strands of Ag-coated copper (diameter of metal filament: 40 μm), three strands of 75 denier polyester + one strand of 20 denier polyester, being used in the third process | Three strands of polyurethane coated copper (diameter of metal filament: 40 μm, diameter of the filament including coated part: 48 μm), three strands of 75 denier polyester | Three strands of polyurethane coated copper (diameter of metal filament: 40 μm, diameter of the filament including coated part: 48 μm), three strands of 75 denier polyester + one strand of 75 denier polyester, being used in the third process | Three strands of polyurethane coated copper (diameter of metal filament: 60 μm, diameter of the filament including coated part: 72 μm), three strands of 75 denier polyester | Three strands of polyurethane coated copper (diameter of metal filament: 60 μm, diameter of the filament including coated part: 70 μm), three strands of 75 denier polyester + one strand of 75 denier polyester, being used in the third process |
| Denier | 547 | 570 | 549 | 634 | 957 | 1058 |
| Content (%) | Metal 56.4 Polyester 43.6 | Metal 54.5 Polyester 45.5 | Metal 57.3 Polyester 42.7 | Metal 50.3 Polyester 49.7 | Metal 75.5 Polyester 24.5 | Metal 70.0 Polyester 30.0 |
| Thickness (μm) | 199 | 231 | 157 | 221 | 170 | 226 |
| Yield Strength (Load at 0.2% offset Yield, N) | 3.92 | 4.45 | 3.57 | 4.47 | 4.74 | 5.99 |
| The Rate of increase in yield strength (%) | Increase of 13.5% | | Increase of 25.2% | | Increase of 26.4% | |
| Tensile strength (N) | 13.3 | 13.2 | 12.74 | 17.41 | 13.03 | 17.62 |
| The Rate of increase in strength at the time of cutting (%) | Similar | | Increase of 36.7% | | Increase of 35.2% | |
| Resistance of thread (Ω/cm) | 0.04861 | 0.04899 | 0.005205 | 0.0516 | 0.0219 | 0.0225 |
| Resistance of embroidery (Ω/cm) | 0.08454 | 0.08400 | 0.08654 | 0.09399 | 0.04204 | 0.04080 |
| Standard deviation in resistance of embroidery (Ω/cm) | 0.004545 | 0.001765 | 0.003916 | 0.001904 | 0.021800 | 0.007756 |
| ction rate of standard deviation in resistance of embroidery resulting from the improved method | Reduction of 61.2% | | Reduction of 51.4% | | Reduction of 64.6% | |

METHOD OF PRODUCING ELECTRICALLY CONDUCTIVE METAL COMPOSITE YARN HAVING INCREASED YIELD STRENGTH, COMPOSITE YARN PRODUCED BY THE METHOD AND EMBROIDERED CIRCUIT PRODUCED USING THE COMPOSITE YARN

TECHNICAL FIELD

The present invention relates, in general, to a method of producing an electrically conductive metal composite yarn applicable to a smart textile in which electrical, electronic and IT technologies are combined with textile-based electronic circuit technologies, an electrically conductive metal composite yarn produced by the method, and an embroidered circuit produced using the electrically conductive metal composite yarn, and, more particularly, to a method of producing an electrically conductive metal composite yarn having increased yield strength by producing a covered yarn by wrapping a conductive yarn around a surface of a yarn, collecting multiple strands of a twisted covered-yarn produced by additionally twisting the covered yarn, and wrapping a yarn around the surface of the multiple strands in a covered state in an opposite direction to twist of the twisted covered-yarn, an electrically conductive metal composite yarn produced by the method, and an embroidered circuit produced using the electrically conductive metal composite yarn.

BACKGROUND ART

In general, textiles (material or fabric) are used in our daily lives as clothes, bedclothes, and the like.

When an electronic technology is applied to the textile, smart textile products having new functions, such as heating clothes, electronic protective gears, heath monitoring, rehabilitation treatment and the like can be realized.

A smart textile is a representative technology for realizing the era of ubiquitous and refers to a new type of future textile in which an information technology (IT), a nanotechnology (NT), a biotechnology (BT), an environmental technology (ET), and the like are interconnected.

As a result of various kinds of research conducted for realizing a smart textile, in order to carry electric current and provide shielding from an electric field, technologies of including a conductive yarn in a yarn and including metal coated yarns have been publicly known. These electrically conductive metal composite yarns have been fabricated as fabrics and clothing products.

As such, the electrically conductive metal composite yarns are used in the smart textile combined with an electronic technology, thereby enabling electronic functions such as the supply of electricity, the transmission of signals, touch sensing, or the like to be performed.

Conventional arts relating to the electrically conductive metal composite yarns which can be used in the smart textile are Korean Patent No. 0688899 entitled "Electric conduction strong metal complex thread manufacturing method and electric conduction strong metal complex thread using the method," Korean Patent No. 0895092 entitled "Electrically conductive sewing thread for power and data transmission line of smart interactive textile systems," Korean Patent No. 1015563 entitled "Electrically conductive metal composite embroidery yarn and embroidered circuit using thereof," and the like.

In the conventional arts, the electrically conductive metal composite yarn is produced by a first process of wrapping multiple strands of a conductive yarn around the surface of a yarn in a covered state to form a large number of twists per meter, a second process of performing ply twist to the right to form a large number of twists per meter in a state of wrapping the conductive yarn around the surface of the yarn through the first process, a third process of performing ply twist to the left to form a large number of twists per meter by plaiting the conductive yarn which is ply-twisted to the right by the second process.

The electrically conductive metal composite yarn produced by the manufacturing method according to the conventional art is problematic in that yield strength of the conductive yarn is weak.

In other words, checking an embroidered circuit of a smart textile made by an embroidery process, the regularity of electric resistance of the embroidered circuit is non-uniform.

This is because when the electrically conductive metal composite yarn stretches due to an external force applied during an embroidery process as the yield strength of the conductive yarn in the electrically conductive metal composite yarn is weak, the conductive yarn in the inside thereof stretches or is cut.

In order to overcome this problem, the electrically conductive metal composite yarn should be prevented from stretching due to an external force applied to the composite yarn during the embroidery process.

In general, the strength of thread is increased according to an increase of the number of twists per meter, but in order for strength of the electrically conductive metal composite yarn to increase by increasing the number of twists per meter thereof, because a torque occurs, feeding the electrically conductive metal composite yarn is interrupted during the embroidery process, and an increase in the number of twists per meter beyond the range of a limit also causes a problem of continuous elongation of the metal filament (the conductive yarn) in the structure of the electrically conductive metal composite yarn. Thus, in order to minimize a variation in electric resistance of the conductive yarn by preventing the electrically conductive metal composite yarn from stretching due to the external force during the embroidery process, a method increasing yield strength of the conductive yarn rather than a method of increasing strength by simply increasing the number of twists per meter should be used.

However, since the electrically conductive metal composite yarn produced by the conventional arts has weak yield strength in terms of the conductive yarn in the inside thereof, checking an embroidered circuit produced using the same, the regularity of electric resistance is non-uniform.

Furthermore, among the conventional arts, Korean Patent No. 1015563 entitled "Electrically conductive metal composite embroidery yarn and embroidered circuit using thereof," which is directed to covering a metal filament yarn (i.e. conductive yarn) using a protective thread (i.e. yarn) of 30 denier or less, has the following several problems.

First, it is very difficult to practically produce a metal composite yarn having a uniform and thin thickness and uniform appearance using a method of covering a general yarn with a metal covered yarn formed by wrapping a metal filament yarn (i.e. conductive yarn) around a general yarn having a thin thickness of 30 denier or less.

Second, even if such a metal composite yarn is made, with regard to the electrically conductive metal composite yarn produced by using the conductive yarn covered with the general yarn for protection, it is difficult to cause electrical contact among the conductive yarns in the inside of threads, and accordingly, when a defect is generated at a specific part of the conductive yarn inside the electrically conductive metal composite yarn, a variation in electric resistance of the embroidered circuit will be largely increased.

Third, electrical contact among the embroidered circuits produced using the electrically conductive metal composite yarn as well as the electrical contact among conductive yarns inside the electrically conductive metal composite yarn may not be utilized in producing a necessary sensing structure.

DISCLOSURE

Technical Problem

Accordingly, the present invention has been made keeping in mind the above problem in which a conductive yarn of an electrically conductive metal composite yarn produced by the conventional art has weak yield strength, an object of the present invention is to provide a method of producing an electrically conductive metal composite yarn having increased yield strength by producing a covered yarn by wrapping a conductive yarn around the surface of a yarn, and producing a twisted covered-yarn by additionally twisting the covered yarn, and producing a reinforced plied-yarn by wrapping a yarn around the surface of multiple strands of the twisted covered-yarn.

Another object of the present invention provides a method of producing an electrically conductive metal composite yarn having increased yield strength by additionally twisting a reinforced plied-yarn having increased yield strength, which is produced by wrapping a yarn around the surface of multiple strands of the twisted covered-yarn in a covered state, so as to have a large number of twists per meter.

A further object of the present invention provides an electrically conductive metal composite yarn produced by the production method which can increase yield strength and tensile strength, and an embroidered circuit produced using the electrically conductive metal composite yarn.

Technical Solution

In order to accomplish the above objects, the present invention provides a method of producing an electrically conductive metal composite yarn having increased yield strength, the method including: a first process of producing a covered yarn by wrapping a conductive yarn around the surface of a yarn; a second process of producing a twisted covered-yarn by additionally twisting the covered yarn produced through the first process; and a third process of producing a reinforced plied-yarn by wrapping a yarn around the surface of multiple strands of the twisted covered-yarn in a covered state to increase yield strength of the conductive yarn.

Furthermore, the method may further include a fourth process of producing a twisted reinforced plied-yarn by additionally twisting the reinforced plied-yarn produced by the third process, wherein the yarn in the third process is wrapped around the surface of multiple strands of the twisted covered-yarn in an opposite direction to a twist direction of the twisted covered-yarn, and the yarn in the third process is wrapped to have the number of twists per meter ranging from 20 to 300 TM (Twist per Meter).

Furthermore, the present invention provides an electrically conductive metal composite yarn having increased yield strength produced by the production method as described above, and the present invention also provides an embroidered circuit produced using the electrically conductive metal composite yarn.

Advantageous Effects

According to the present invention, a method of producing an electrically conductive metal composite yarn having increased yield strength according to the present invention having the configurations as described above enables yield strength of the electrically conductive metal composite yarn to be increased.

As the yield strength is increased, a conductive yarn can be prevented from stretching or being cut during an embroidery process, and accordingly, regularity of electric resistance can be also prevented from being non-uniform.

Also, the method according to the present invention is a production method of the electrically conductive metal composite yarn having increased yield strength for allowing protection of the conductive yarn from frictional force applied when the electrically conductive metal composite yarn passes through substrate fabric, thus being very useful to industrial development.

DESCRIPTION OF DRAWINGS

FIG. 6 is a comparison table for used materials and characteristics of the electrically conductive metal composite yarns produced by the conventional art and the present invention shown in FIGS. 5A to 5F.

Figure 1:
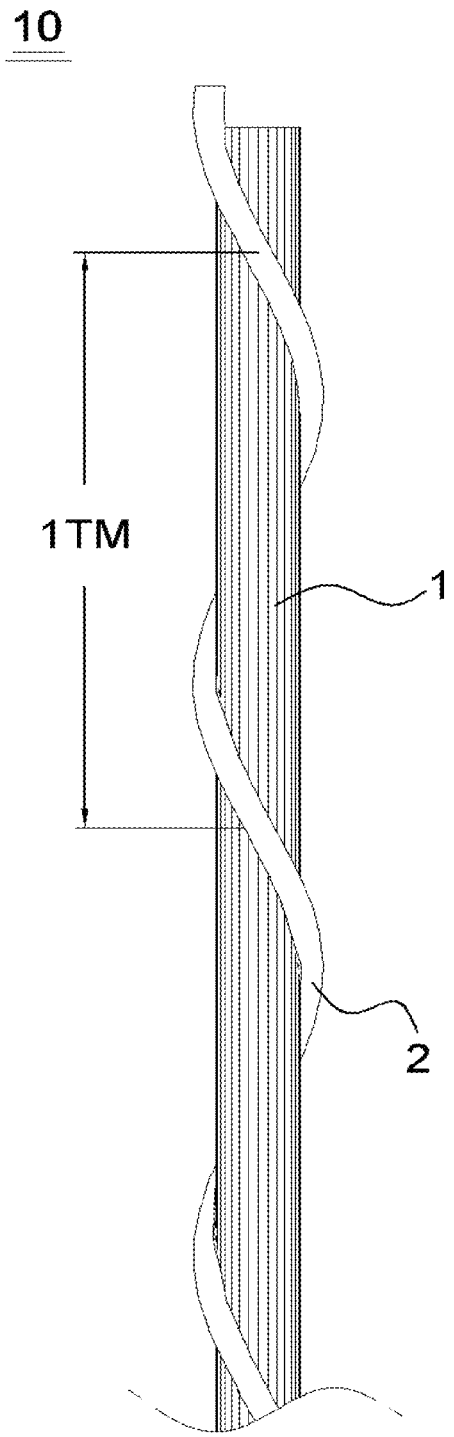
FIG. 1 is a view illustrating one example of a covered yarn produced by a first process of the present invention.

<Description of the Reference Numerals in the Drawings>

| | | | |
|---|---|---|---|
| 1: | Yarn | 2: | Conductive yarn |
| 10: | Covered yarn | 20: | Twisted covered-yarn |
| 30: | Reinforced plied-yarn | | |
| 40: | Twisted reinforced plied-yarn | | |

BEST MODE

Hereinbelow, a method of producing an electrically conductive metal composite yarn having increased yield strength according to the present invention will be described in more detail with reference to the accompanying drawings.

The present invention will now be described in detail based on aspects (or embodiments). The present invention may, however, be embodied in many different forms and should not be construed as being limited to only the embodiments set forth herein, but should be construed as covering modifications, equivalents or alternatives falling within ideas and technical scopes of the present invention.

In the figures, like reference numerals, particularly, tens and units, or reference numerals having like tens, units and letters refer to like elements having like functions throughout, and unless the context clearly indicates otherwise, elements referred to by reference numerals of the drawings should be understood based on this standard.

Also, for convenience of understanding of the elements, in the figures, sizes or thicknesses may be exaggerated to be large (or thick), may be expressed to be small (or thin) or may be simplified for clarity of illustration, but due to this, the protective scope of the present invention should not be interpreted narrowly.

The terminology used herein is for the purpose of describing particular aspects (or embodiments) only and is not intended to be limiting of the present invention. As used herein, the singular forms are intended to include the plural forms as well, unless the context clearly indicates otherwise. It will be further understood that the terms "comprises," "comprising,", "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

A method of producing electrically conductive metal composite yarn having increased yield strength according to the present invention is largely composed of: a first process of producing a covered yarn 10; a second process of producing a twisted covered-yarn 20; a third process of producing a reinforced plied-yarn 30; and a fourth process of producing a twisted reinforced plied-yarn 40.

A high-strength and low-shrinkage polyester or nylon based material is used in a yarn 1 used in the present invention, and metal such as gold, silver, copper having excellent conductivity, stainless steel having excellent strength and the like is used in a conductive yarn 2.

A surface of the conductive yarn 2 may be coated with an insulating material, such as enamel, PVC and the like.

It is preferable that a thickness of the yarn 1 range from 20 to 500 denier, and that a single strand thickness of the conductive yarn 2 range from 0.01 to 0.1 mm.

The first process includes, as shown in FIG. 1, producing the covered yarn 10 by wrapping the single conductive yarn or multiple conductive yarns 2 around a surface of the yarn 1.

It is preferable that the number of twists per meter of the covered yarn 10 range from 20 to 300 TM.

Figure 2:
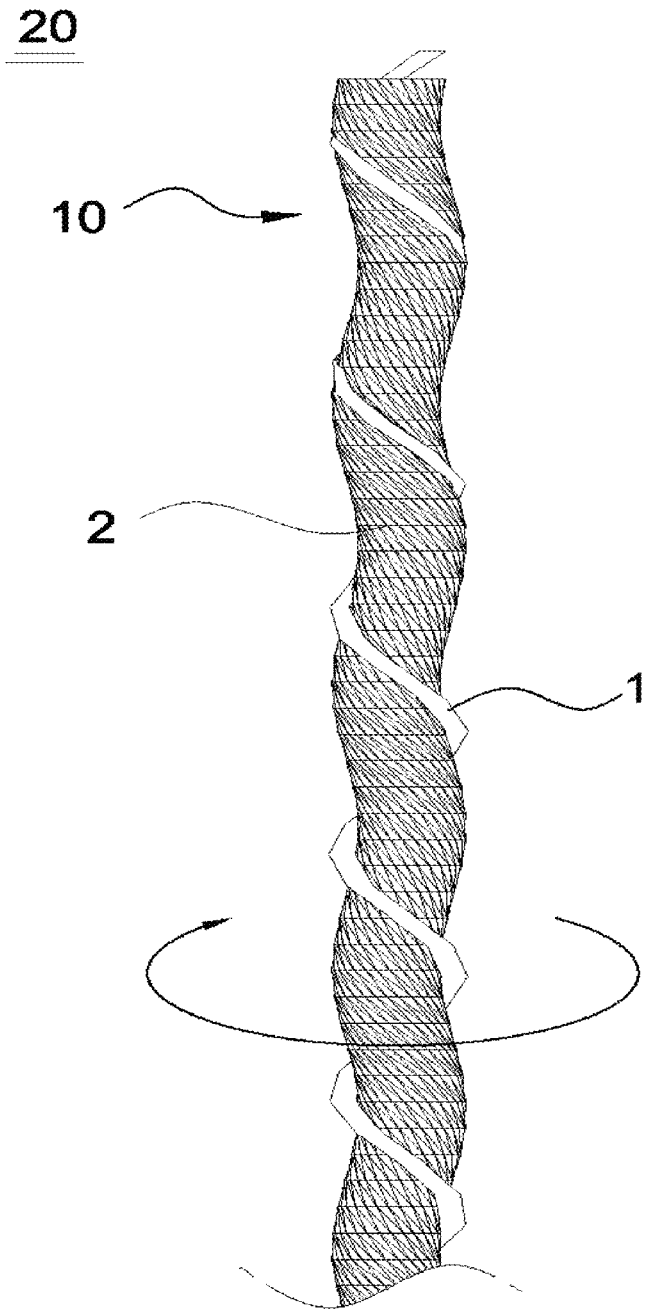
FIG. 2 is a view illustrating one example of a twisted covered-yarn produced by a second process of the present invention.

The second process includes, as shown in FIG. 2, producing the twisted covered-yarn 20 by additionally twisting the covered yarn 10 produced through the first process.

It is preferable that the number of twists per meter of the twisted covered-yarn 20 range from 200 to 1000 TM.

Figure 3:
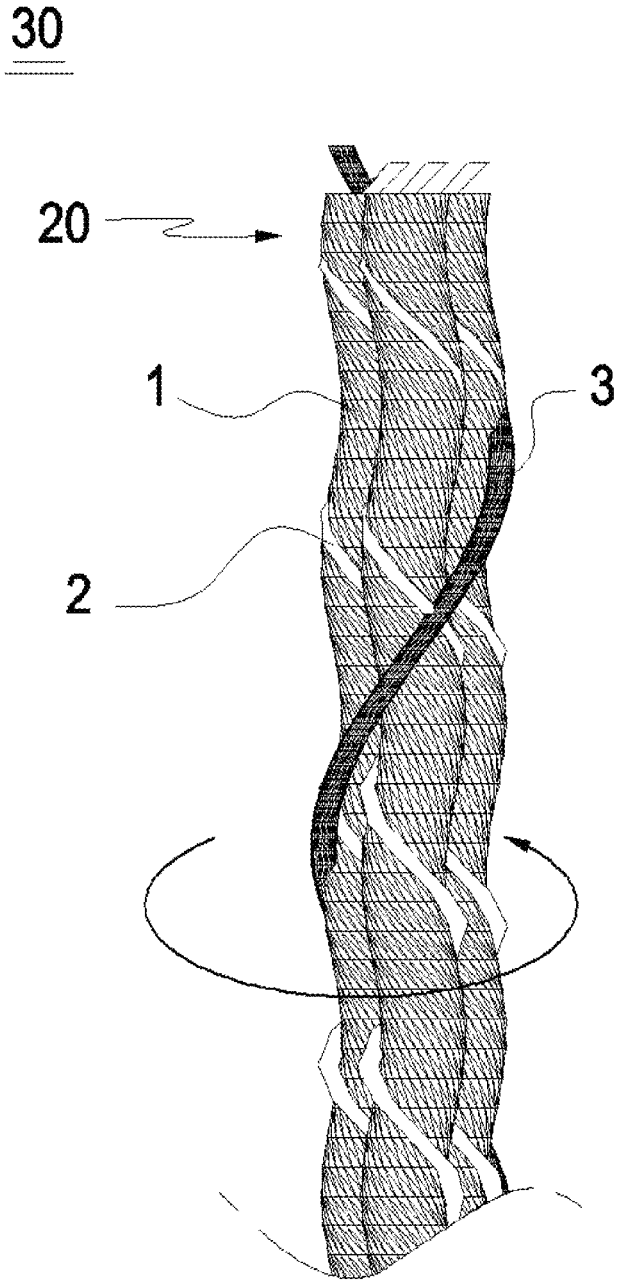
FIG. 3 is a view illustrating one example of a reinforced plied-yarn produced by a third process of the present invention.

The third process includes, as shown in FIG. 3, producing the reinforced plied-yarn 30 by wrapping a yarn 3 around the surface of multiple strands of the twisted covered-yarn 20 (namely, the several twisted covered-yarns 20 are collected together) produced through the second process in a covered state in an opposite direction to a twist direction of the twisted covered-yarn 20.

It is preferable that the number of twists per meter of the reinforced plied-yarn 30, namely, the number of times the yarn 3 is wrapped around the surface of the twisted covered-yarn 20 range from 20 to 300 TM, which is low in number of twists per meter. When the number of twists per meter of the reinforced plied-yarn 30 is high, the reinforced plied-yarn 30 becomes hard, and thus the reinforced plied-yarn loses flexibility, and when the electrically conductive metal composite yarn is used for a sensor purpose, an electrical contact between the conductive yarns 2 is interrupted, so it is preferable that the number of twists per meter of the reinforced plied-yarn 30 is low.

Figure 4:
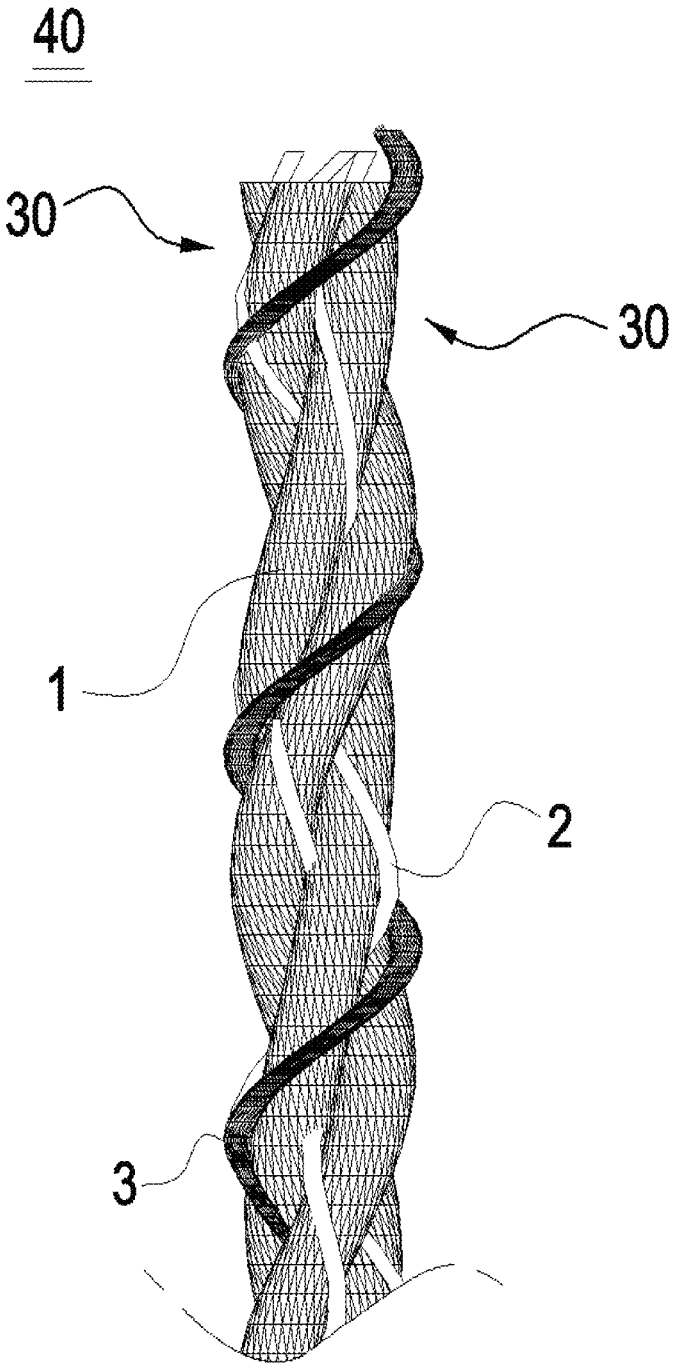
FIG. 4 is a view illustrating one example of a twisted reinforced plied-yarn produced by a fourth process of the present invention.
Figure 5A:
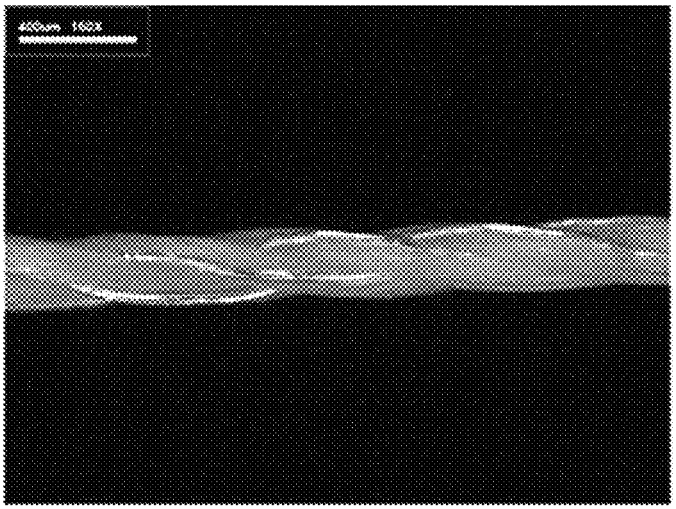
FIGS. 5A to 5F are photos in place of a view for electrically conductive metal composite yarns produced by a conventional art and the present invention.
Figure 5B:
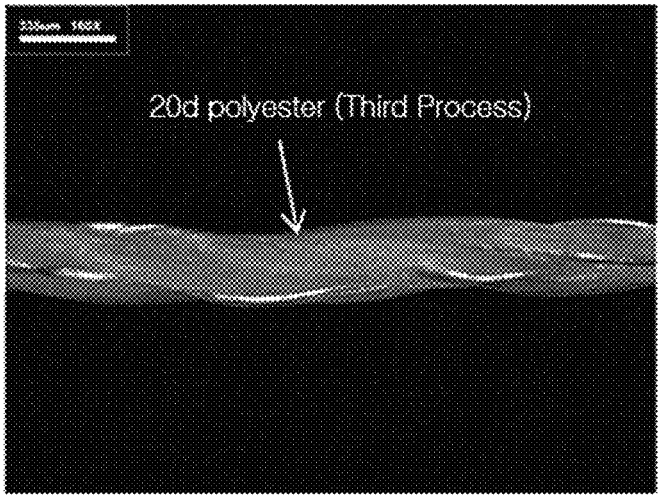
Figure 5C:
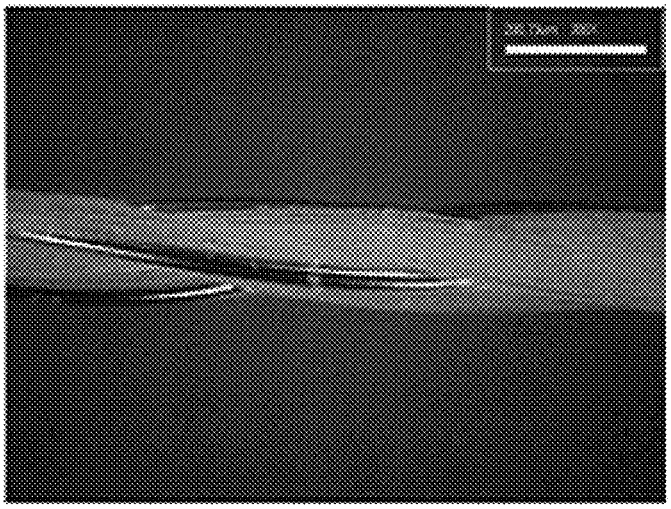
Figure 5D:
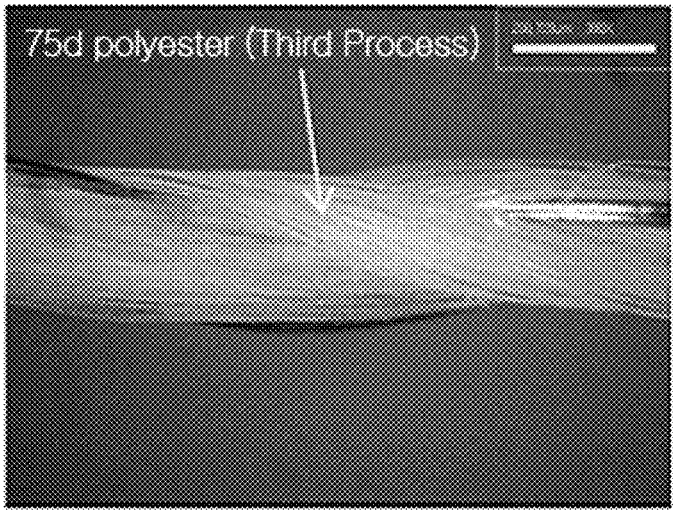
Figure 5E:
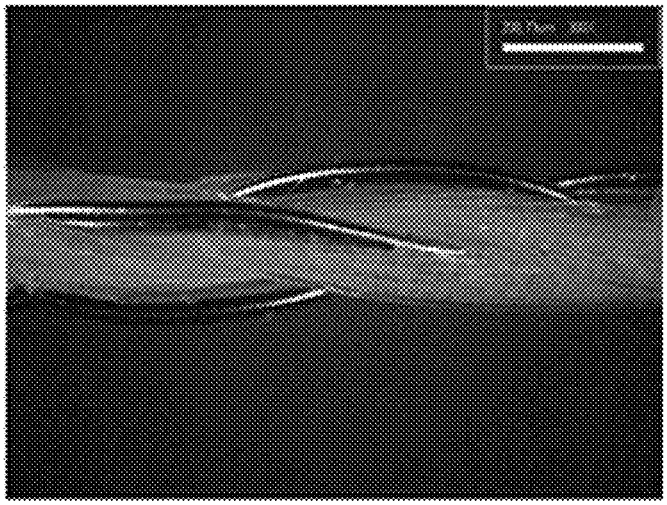
Figure 5F:
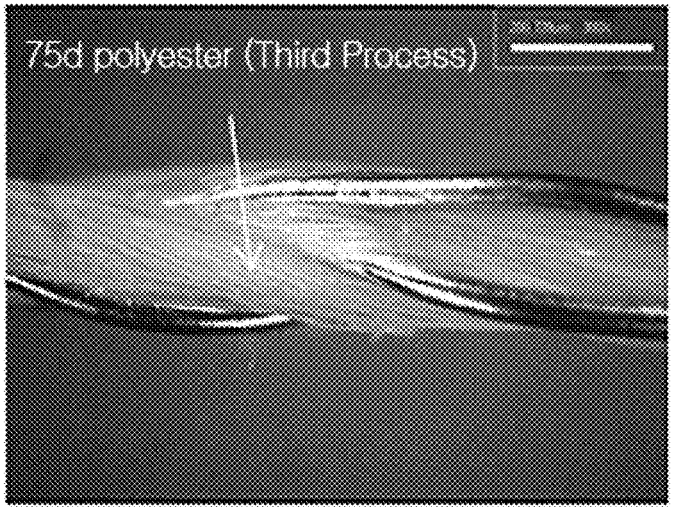

The fourth process includes, as shown in FIG. 4, producing the twisted reinforced plied-yarn 40 by additionally twisting the reinforced plied-yarn 30 produced through the third process. The twisted reinforced plied-yarn 40 becomes an electrically conductive metal composite yarn having increased yield strength, which is finally produced according to the present invention.

It is preferable that an additional twisting direction of the reinforced plied-yarn 30 during the fourth process be the same as a covering direction of the yarn 3 during the third process so that a covered state of the yarn 3 can be prevented from unwinding.

It is preferable that the number of twists per meter of the twisted reinforced plied-yarn range from 200 to 1000 TM.

In the present invention, the reinforced plied-yarn 30 is produced by covering the yarn 3 in low number of twists per meter, in the third process, around the surface of the multiple strands of the twisted covered-yarn 20 produced through the first and second processes, and the reinforced plied-yarn 30 is additionally twisted in the fourth process so as to have appropriate strength so that yield strength of the twisted reinforced plied-yarn 40 (i.e. finally produced electrically conductive metal composite yarn) produced in the fourth process can be increased.

Accordingly, when an embroidered circuit is made using the electrically conductive metal composite yarn produced by the present invention, the conductive yarn 2 may be prevented from stretching or being cut, so the regularity of electric resistance of the embroidered circuit is improved.

Furthermore, as the conductive yarn 2 is wrapped by the yarn 3 in the third process, the conductive yarn 2 is protected from friction applied when the electrically conductive metal composite yarn passes through substrate fabric during an embroidery process as well as during a re-winding process of the electrically conductive metal composite yarn.

FIGS. 5A to 5F are photos in place of a view illustrating each of the electrically conductive metal composite yarns produced by then existing method (without performing the third process of the present invention) and the improved method according to the present invention (the third process of the present invention being applied).

FIG. 6 is a comparison table for materials of the yarns 1, 3 and the conductive yarn 2, and characteristics, such as electric resistance, yield strength and tensile strength of the electrically conductive metal composite yarns, and resistance of embroidery of the electrically conductive metal composite yarns used in the existing method and the improved method shown in FIGS. 5A to 5F.

As shown in the experimental table of FIG. 6, comparing the electrically conductive metal composite yarn produced by the present invention with the electrically conductive metal composite yarn produced by the existing method, yield strength of the electrically conductive metal composite yarn N2 produced by the present invention in which an uninsulated conductive yarn is used for a conductive yarn 2 is increased up to 13.5%, and yield strength of the electrically conductive metal composite yarn C2 produced by the present invention in which an insulated conductive yarn is used for a conductive yarn 2 is also increased up to 25.2%.

In the case of N2, strength at the time of cutting is similar to that of the existing method, but tensile strength of the electrically conductive metal composite yarn C2 produced by the present invention in which an insulated conductive yarn is used for a conductive yarn 2 is increased up to 36.7%.

Furthermore, with regard to electric regularity of the conductive yarn, namely, a standard deviation of embroidery resistance, it can be confirmed that a standard deviation of N2 produced by the present invention in which an uninsulated conductive yarn is used for a conductive yarn 2 is reduced up to 61.2%, and a standard deviation of C2 produced by the present invention in which an insulated conductive yarn is used for a conductive yarn 2 is reduced up to 51.4%.

As confirmed through the experimental table, the electrically conductive metal composite yarn according to the present invention has remarkably increased yield strength, strength, and regularity of resistance, and accordingly, it can be usefully utilized in the development of a high-quality smart textile.

As described above, the specific shapes and structures of the present invention disclosed for illustrative purposes above with reference to the drawings are only one example for explaining the method of producing an electrically conductive metal composite yarn having increased yield strength, the electrically conductive metal composite yarn produced by the method, and the embroidered circuit produced using the electrically conductive metal composite yarn, those skilled in the art will appreciate that various modifications and changes are possible, and these modifications and changes should be interpreted to fall within the protective scope of the present invention.

The invention claimed is:

1. A method of producing an electrically conductive metal composite yarn having increased yield strength, the method comprising:

a first process of producing a covered yarn by wrapping a conductive yarn around a surface of a yarn;

a second process of producing a twisted covered-yarn by additionally twisting the covered yarn produced through the first process; and a third process of producing a reinforced plied-yarn by wrapping a yarn around a surface of multiple strands of the twisted covered-yarn in a covered state to increase yield strength of the conductive yarn.

2. The method of claim 1, further comprising a fourth process of producing a twisted reinforced plied-yarn by additionally twisting the reinforced plied-yarn produced by the third process.

3. The method of claim 1, wherein the yarn in the third process is wrapped around the surface of multiple strands of the twisted covered-yarn in an opposite direction to a twist direction of the twisted covered-yarn.

4. The method of claim 1, wherein the yarn in the third process is wrapped to have the number of twists per meter ranging from 20 to 300 TM (Twist per Meter).

5. An electrically conductive metal composite yarn having increased yield strength produced by the production method of claim 1.

6. An embroidered circuit produced using the electrically conductive metal composite yarn having increased yield strength produced by the production method of claim 1.

* * * * *